United States Patent [19]

Parker

[11] Patent Number: 4,597,245

[45] Date of Patent: Jul. 1, 1986

[54] APPARATUS FOR FILLING AND SEALING A CONTAINER

[75] Inventor: Wendell E. Parker, Traverse City, Mich.

[73] Assignee: Kelsey-Hayes Company, Romulus, Mich.

[21] Appl. No.: 717,484

[22] Filed: Mar. 29, 1985

Related U.S. Application Data

[63] Continuation of Ser. No. 364,789, Apr. 2, 1982, abandoned.

[51] Int. Cl.[4] ..... B65B 31/02; B65B 1/04

[52] U.S. Cl. ..... 53/510; 53/268; 53/274; 53/310; 53/328

[58] Field of Search ..... 53/88, 94, 101, 268, 53/274, 90, 310, 328, 432, 471, 489, 510; 141/40

[56] References Cited

U.S. PATENT DOCUMENTS

| | | | |
|---|---|---|---|
| 607,328 | 7/1898 | Beebe | 53/310 X |
| 1,365,454 | 1/1921 | Calleson | 53/274 X |
| 1,477,485 | 12/1923 | Haskell | 53/274 X |
| 2,101,156 | 12/1937 | Payne | 53/274 X |
| 2,198,752 | 4/1940 | Barr | 53/432 X |
| 2,287,831 | 9/1956 | Renard | 53/274 X |
| 2,761,603 | 9/1956 | Fairchild | 53/274 X |
| 3,057,131 | 10/1962 | McKinley | 53/328 X |
| 3,191,354 | 6/1965 | McElroy | 53/510 X |
| 3,313,326 | 4/1967 | Pellerino | 141/40 |
| 3,996,725 | 12/1976 | Wales | 53/510 X |

*Primary Examiner*—John Sipos

*Attorney, Agent, or Firm*—Harold W. Milton, Jr.

[57] ABSTRACT

An apparatus for filling a container (12) having a receiving passage (14) with material and sealing the receiving passage (14) with a spherical sealing plug which is larger than the receiving passage (14) of the container (12) with the container (12) being subjected to a vacuum before and while being filled. A snout assembly (54) is movably mounted on a support structure (20, 22, 24) and includes a large piston-like portion (59) in sliding engagement within a guideway (28) in a housing (26) with a smaller tubular snout member (62) extending downwardly and into a fill passage (30) which is in sealing engagement with the receiving passage (14) of the container (12). The larger piston-like portion (59) of the snout assembly (54) has a material-receiving chamber (63) and a tubular valve member (68) engages a valve seat (66) to control the flow of material from the material chamber (63) to the delivery passage (56) and out the discharge end (58) of the smaller tubular snout member (62). The tubular snout member (62) is inserted into the container-receiving passage (14) for filling the container until the container (12) is full of material to the discharge end (58) whereupon material flow through the snout member (62) ceases. The valve member (68) is then closed against valve seat (66) to terminate material flow into the snout member (62). The snout member (62) is then retracted to empty the material in the snout member (62) below or downstream of the closed valve member (68) into the receiving passage (14) of the container, the volume of material emptied from the snout member (62) into the receiving passage (14) being insufficient to completely fill the receiving passage (14). After the snout member (62) is withdrawn, a spherical sealing plug is dispensed from a magazine and rolled into position engaging the container-receiving passage after which the spherical sealing plug is engaged with the discharge end of the snout member to force the sealing plug into the container-receiving passage for sealing the container.

12 Claims, 6 Drawing Figures

APPARATUS FOR FILLING AND SEALING A CONTAINER

This application is a continuation of application Ser. No. 364,789, filed 4/2/82, now abandoned.

TECHNICAL FIELD

This invention relates to the filling and sealing of a container. The invention was specifically developed for and has found utility in the filling of a cavity in a container with powdered metal in a vacuum environment. After the container is filled and sealed it is subjected to heat and pressure for compacting and densifying the powdered metal within the container.

BACKGROUND ART

There are systems known to the prior art which function to apply a vacuum to a container before filling the container with powdered metal and which seal the container before the container is removed from the assembly to prevent the ingress of gases into the cavity filled with the powdered metal. The problem with such prior art assemblies is the arrangement of the components and their interaction for applying a vacuum to the container, filling the container and then sealing the container while maintaining the vacuum within the system. The initial problem is the determination of when the container is actually full, i.e., the container must be full to obtain proper compaction of the powder. Secondarily, there has been the problem of the association between the system which supplies a plug for plugging the container for sealing the container after it has been filled and the means for forcing the plug into the container while maintaining the vacuum within the system. The subject invention more effectively fills the container until it is full and, secondarily, effectively seals the container while maintaining the vacuum.

SUMMARY OF THE INVENTION

The subject invention relates to an assembly for filling a container having a receiving passage with material by utilizing a snout means having a material delivery passage for receiving material and having a discharge end opening toward the container-receiving passage. The snout means is movable from an initial position into the container-receiving passage to a fill position where material flows through the snout means and into the container until the container is full of material to the discharge end whereupon material flow through the snout means ceases. The flow of material into the snout means is terminated and the snout means is retracted from the container-receiving passage to empty the material in the snout means below the point of termination of flow into the container-receiving passage.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFFERED EMBODIMENT

Figure 1:
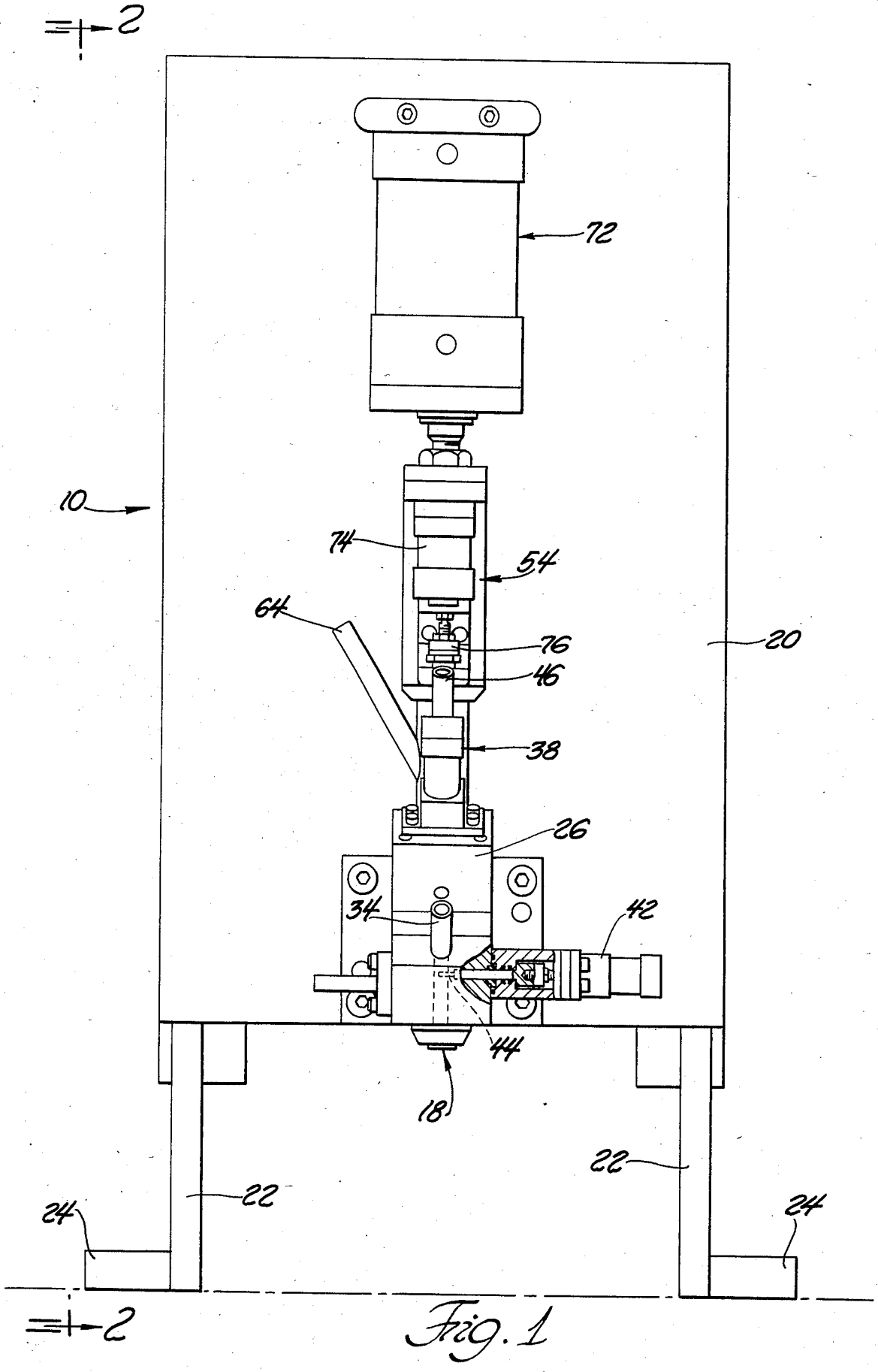
FIG. 1 is an elevational view of the front of an assembly constructed in accordance with the subject invention.
Figure 2:
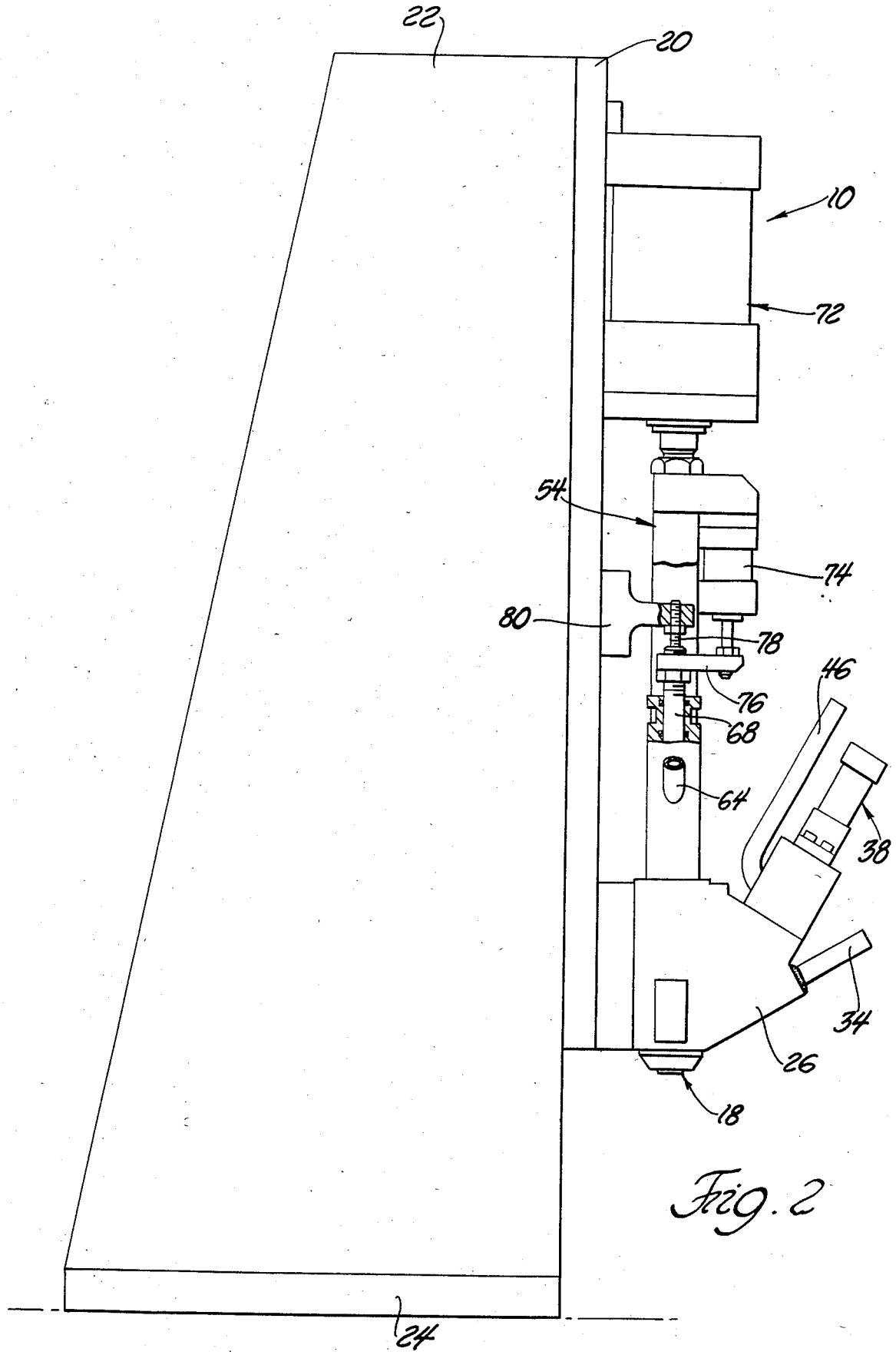
FIG. 2 is a side view taken substantially along line 2—2 of FIG. 1.

A filling assembly constructed in accordance with the subject invention is generally shown at 10 in FIGS. 1 and 2. The assembly 10 fills a container 12 shown only in FIGS. 3–6. The container 12 has a receiving passage 14 of a predetermined length and volume which opens into a cavity 16 within the container 12. The cavity 16 may be of various different shapes and configurations depending upon the desired shape of the final product.

The assembly 10 includes a seal assembly, generally indicated at 18, which engages the container 12 about the container-receiving passage 14 to effect an air or gas-tight seal between the assembly and the container 12. An appropriate apparatus of various different types may be utilized to hold the container 12 in position tightly against the seal assembly 18.

The assembly 10 includes a support structure including the support panel 20 with rearwardly extending legs 22 and pads 24.

The assembly 10 includes a housing 26 extending from and supported by the panel 20 of the support structure. The housing 26 includes a cylindrical guideway 28 having a conical bottom communicating with a fill passage 30. The fill passage 30 extends through the sealing assembly 18 and is in direct communication with the container-receiving passage 14. The housing 26 includes a vacuum passage 32 attached to a tube 34 having an "on" and "off" valve 36 therein and adapted to be attached to a vacuum source, such as a vacuum pump. The vacuum passage 32 extends to and communicates with the fill passage 30.

Figure 3:
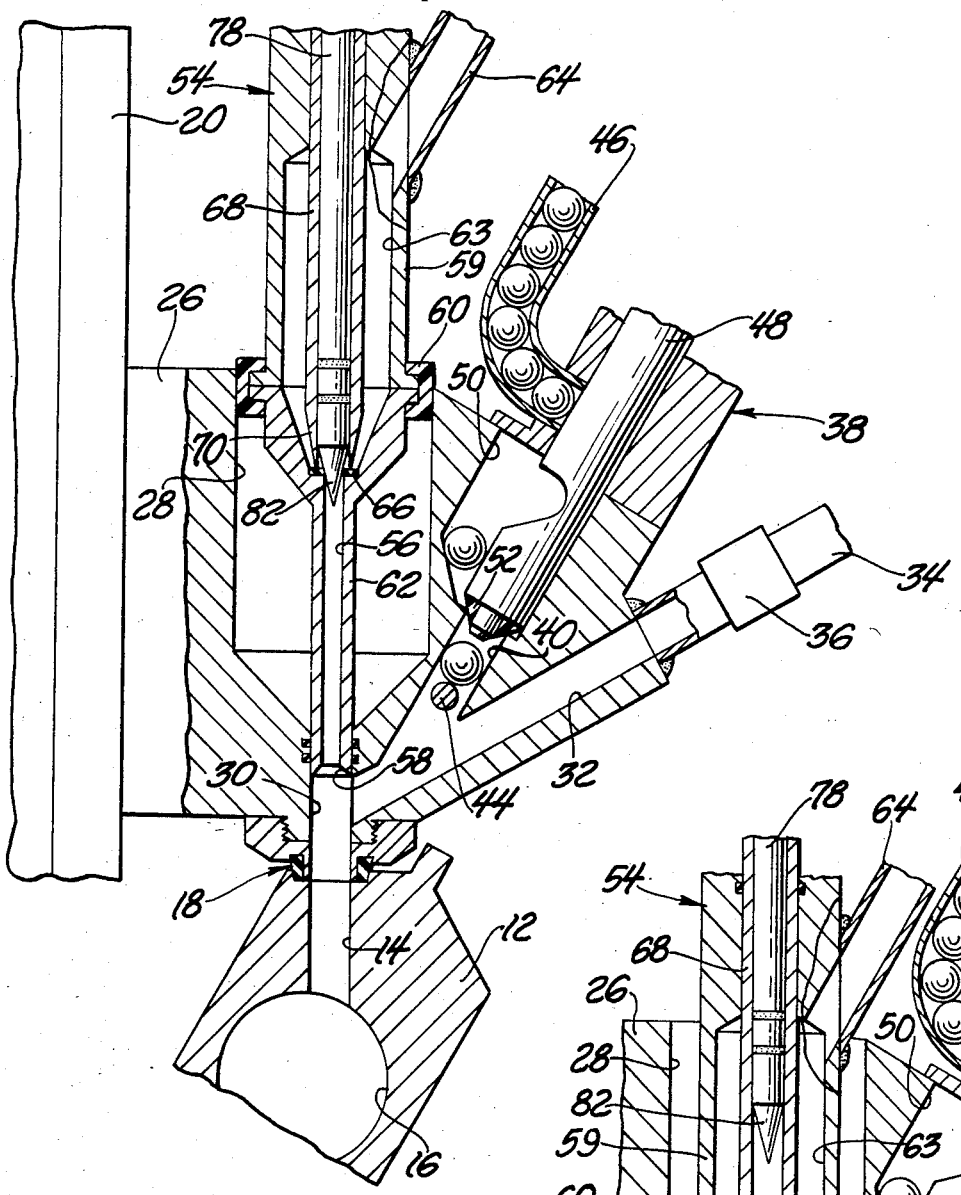
FIG. 3 is an enlarged fragmentary view broken away and in cross section of the central portion of the assembly shown in FIGS. 1 and 2 with the components in the initial position or presequencing mode.
Figure 4:
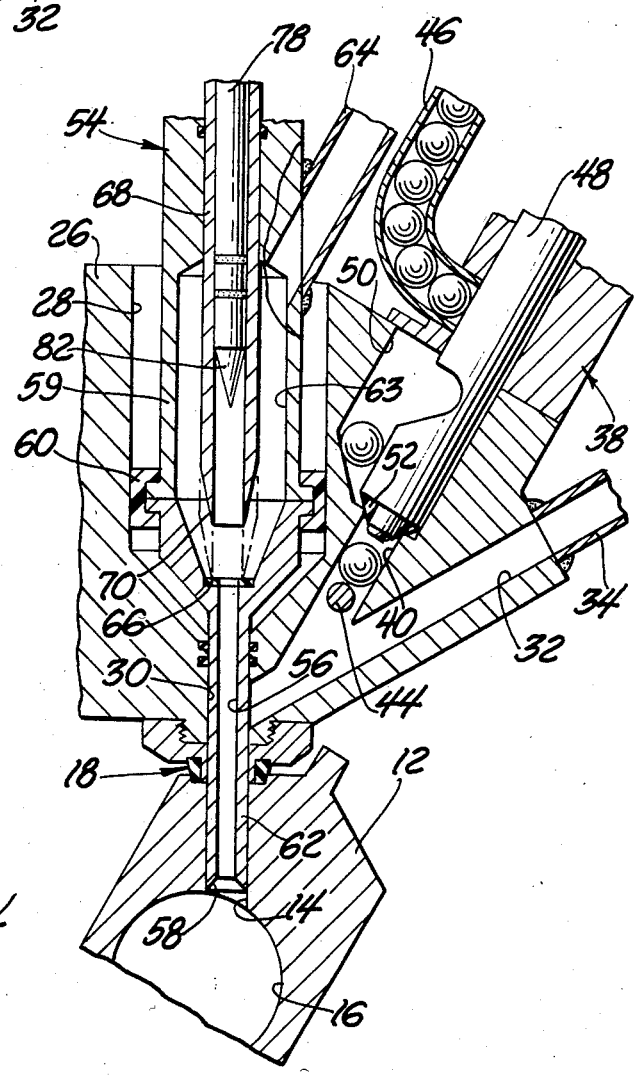
FIG. 4 is a view like FIG. 3 but showing the components in the fill position.
Figure 5:
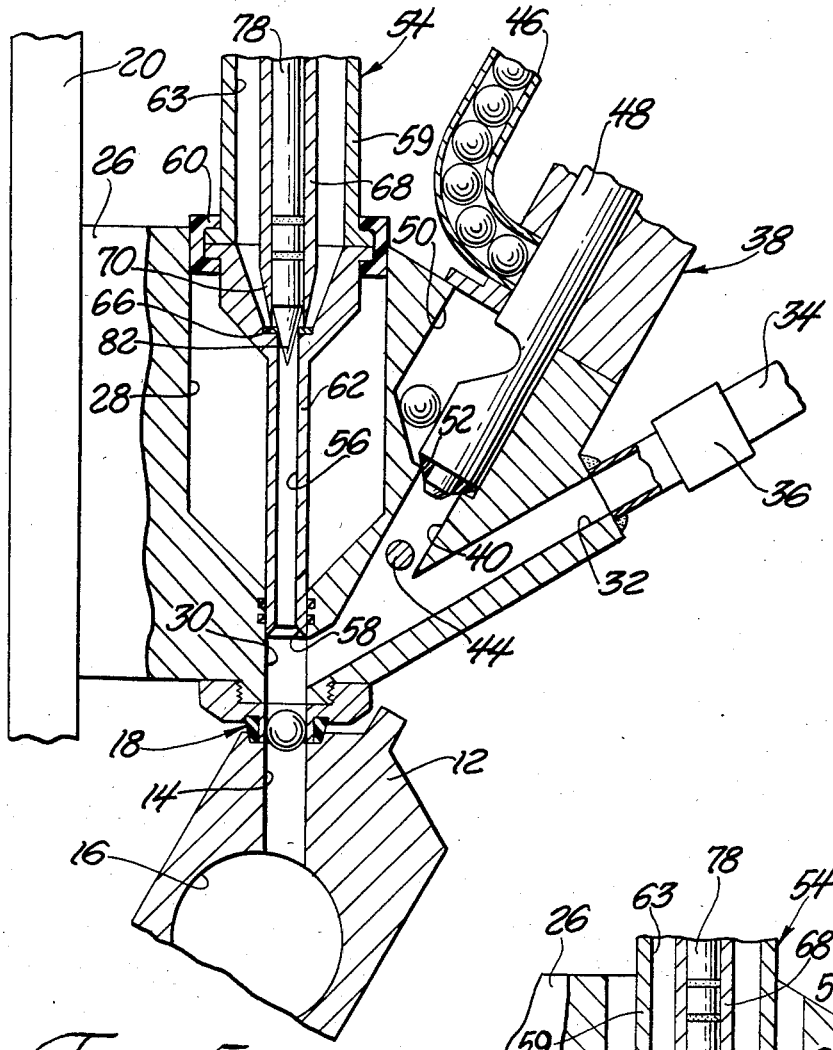
FIG. 5 is a view similar to FIGS. 3 and 4 but showing the components in the position just before sealing the container.
Figure 6:
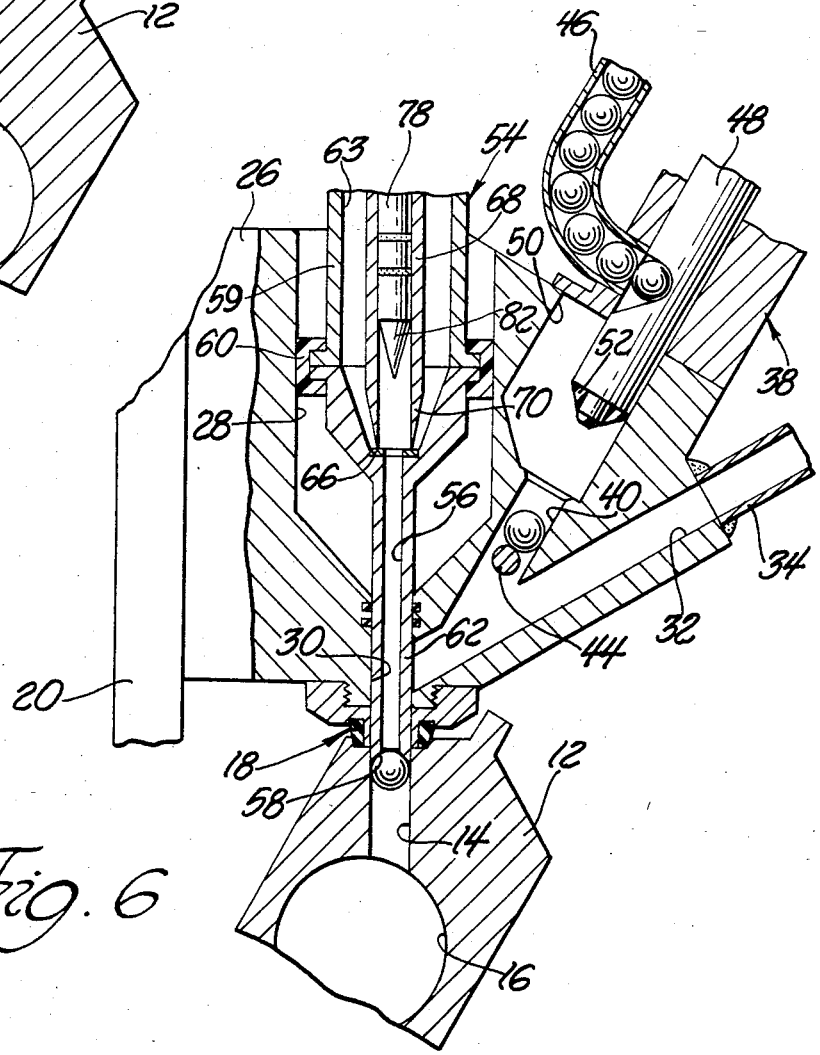
FIG. 6 is a view similar to FIG. 5 but showing the components in the position at which the container has been sealed.

The assembly 10 also includes a sealing plug means generally indicated at 38 for delivering a sealing plug in the form of a spherical plug having a larger diameter than the diameter of the container-receiving passage 14. Within the housing 26 and forming part of the sealing plug means 38 is the plug passage 40 for delivering or allowing a spherical sealing ball or plug to fill passage 30 at a position engaging the entrance of the container-receiving passage 14. The sealing plug means 38 also includes a plug stop means 42, as shown in FIG. 1, which has a plunger 44 for retaining a spherical sealing plug in the plug passage 40 when in an extended position, as shown in FIGS. 3 and 4, but may be retracted to allow the sealing plug to pass into the fill passage. The plug stop means 42 may include an air actuator for moving the plunger 44. The plug seal means 38 includes a plug magazine means comprising the storage tube 46 and the ball valve member 48. The ball valve 48 has a notch therein for receiving a spherical plug from the storage tube 46 and placing same in the adjacent cavity 50. The bottom end of the valve member 48 includes a seal 52 for sealing engagement with the plug passage 40. The seal 52 maintains the vacuum in the plug passage 40. When the ball valve member 48 is retracted from the position shown in FIG. 5 to the position shown in FIG. 6, the spherical plug in the cavity 50 moves to the position shown in FIG. 6 engaging the plunger 44 while at the same time a new spherical plug is picked up from the storage tube 46 by the notch in the valve member 48 and, as the valve member 48 is moved back to sealing engagement with the plug passage 40, the ball from the notch moves into the chamber 50. Thus, the valve member 48 is movable between a sealing position, as illustrated in FIG. 5, for sealing off the plug passage 40 to maintain a vacuum therein, and an open position, as shown in FIG. 6, for delivering one spherical plug to the plug passage 40 upon each opening thereof. Thus, the sealing plug means 38 is, in effect, a magazine means for storing a plurality of spherical plugs, each having a diameter greater than the container-receiving passage 14 for delivering one spherical plug at a time to the fill passage 30 so that the spherical plug engages the container-receiving passage 14 while maintaining a seal 52 between the plug magazine assembly 38 and the fill passage 30 to maintain the vacuum therein.

The assembly 10 includes a snout means, generally indicated at 54, having a material delivery passage 56 for receiving material and having a discharge end 58 opening toward or into the container-receiving passage 14 which ihs communicating with and in sealed engagement with the fill passage 30. The snout means 54 is movable in the fill passage 30 between an initial position shown in FIG. 3 in the fill passage 30 and a fill position extending through the fill passage 30 and, to a predetermined extent, into the receiving passage 14 of the container 12 for delivering material through the delivery passage 56 until the container 12 is full of the material in the discharge end 58 whereupon material flow through the delivery passage 56 ceases.

As will be described more fully hereinafter, the assembly includes material-delivery valve means for controlling the flow of material into the delivery passage 56 so that the flow of material into the delivery passage 56 can and is terminated when the container 12 is full. Thereafter, the snout means 54 is retracted from the container-receiving passage 14 to empty the material in the snout means 54 downstream of the termination of flow by the delivery valve means into the receiving passage 14 of the container.

When the snout means 54 is retracted to the initial position shown in FIG. 5 after the container 12 has been filled, the plunger or stop 44 is retracted to allow the plug to roll to the position engaging the container-receiving passage 14. Thereafter, the snout means 54 is moved to the ram position illustrated in FIG. 6 where it extends through the fill passage 30 and into the receiving passage 14 of the container 12 for forcing the sealing plug into the receiving passage 14 of the container to seal the container.

The snout means 54 includes a circular piston-like upper portion 59 supporting an annular bushing 60 which is in sliding engagement with the guideway 28 in the housing 26. Integral with and extending downwardly from the piston-like portion 59 is a tubular snout member 62 which defines the delivery passage 56. The snout member 62 is of a smaller diameter than the piston-like portion 59 and extends downwardly therefrom and into the fill passage 30 in all positions of the snout means 54. There are seals disposed in the fill passageway 30 to maintain a seal between the housing 26 and the tubular snout member 62. The upper piston-like portion 59 defines a material delivery chamber which is above the delivery passage 56 and is supplied material through a material delivery tube 64 which is adapted for connection to a source of material.

As alluded to above, the assembly includes a material delivery valve means for controlling the flow of material from the delivery chamber 63 to the delivery passage 56. More specifically, there is included an annular valve seat 66 between the delivery chamber 63 and the delivery passage 56. The seal 66 is a radially extending shoulder with an annular seal disposed thereon. The delivery valve means comprises a tubular valve member 68 having an annular sharp lower end 70 for engaging the valve seat 66.

The assembly 10 includes snout actuation means generally indicated at 72 in FIGS. 1 and 2 for moving the snout means 54 and the delivery valve means defined by the valve member 68 between the initial position shown in FIG. 3 and the fill position shown in FIG. 4 and the ram position shown in FIG. 6 all while maintaining the valve member 68 closed and against the valve seat 66 to prevent flow from the delivery chamber 63 into the delivery passage 56. More specifically, the snout actuator 72 may be a hydraulic or air-actuated piston and cylinder which moves the snout means 54 vertically between the various positions. The cylinder 72 is supported by the panel 20 of the support structure.

The assembly includes a valve actuation means 74 supported on the snout means 54 for opening the delivery valve tube member 68 to allow material to flow from the delivery chamber 63 into the delivery passage 56 to fill the container 12 when the snout means 54 is in the fill position, as illustrated in FIG. 4. Again the actuator 74 may be one of various known actuators, as for example an air cylinder. As best illustrated in FIG. 2, the cylinder 74 is connected to a bracket 76 which is, in turn, connected to the upper end of the tubular valve member 68.

A cylindrical sealing mandrel 78 is supported in a stationary fashion through a bracket 80 by the panel 20 of the support structure. The mandrel 78 extends through the tubular valve member 68 to a pointed lower end 82 so that the pointed lower end 82 engages the inner periphery of the annular valve seat 66 inside of the tubular valve member 68 when the snout means 54 is in the initial position illustrated in FIGS. 3 and 5 to maintain the vacuum within the system. In other words, in addition to the tubular valve member 68 engaging the valve seat 66 in the initial position, the pointed end 82 of the stationary mandrel 78 also engages the valve seat to assure no leakage past the valve seat 66.

OPERATION

The assembly is in the initial position illustrated in FIG. 3 when the container 12 is placed into position so that its receiving passage 14 is in sealed communication with the fill passage 30. A vacuum is then applied from the vacuum source through the vacuum passage 32 which, in turn, withdraws all gases from the fill passage 30, the delivery passage 56 in the snout means 54 as well as the cavity 16 in the container 12. Once the vacuum has been attained, the tubular snout member 62, having the discharge end 58, is moved from its initial position shown in FIG. 3 through the fill passage 30 and, to a predetermined extent, into the container-receiving passage 14, to a fill position illustrated in phantom in FIG. 4. This is accomplished by actuation of the actuator 72. After the snout means 54 is in the fill position illustrated in FIG. 4, the valve actuator 74 is actuated to move the tubular valve member 68 from the position shown in phantom in FIG. 4 to the open position shown in full lines whereby material will flow from a source through the tube 64 and into the material delivery chamber 63 and past the valve seat 66 into the delivery passage 56 and into the cavity 16 of the container 12 for filling the container. The material will continue to flow under the force of gravity until its level reaches the discharge end 58 at the bottom of the snout member 62, at which point material flow will naturally cease. The apparatus may include a means of vibrating or thumping the container 12 to make sure the container 12 is properly filled.

After the container 12 is filled the actuator 74 is actuated to move the valve member 68 downwardly so its sharp end 70 engages the valve seat 66. This will leave a predetermined volume of material in the delivery passage 56 below the point of termination of flow at the valve seat 66. Thereafter, the snout means actuator 72 moves the snout means 54 back to the initial position as shown in FIG. 5. As the snout member 62 is retracted, the material filling the delivery passage 56 will empty into the container-receiving passage 14. However, to assure room in the receiving passage 14 for the sealing plug, the volume of the delivery passage 56 below the valve seat 66 is less than the volume of the predetermined extent to which the snout 62 extends into the receiving passage 14 of the container 12.

Thereafter, the plunger 44 is retracted to allow the ball plug to roll down the plug passageway 40 and down the vacuum passageway 32 into the fill passageway 30 to engage the container 12 about the periphery of the container-receiving passage 14, as illustrated in FIG. 5. This is accomplished while the plug valve member 48 remains in the sealed position with the seal 52 sealing off the plug passage 40, as shown in FIG. 5, to prevent any loss of vacuum in the system. The snout means actuator 72 is again actuated to move the snout means 54 and, particularly, the discharge end 58 of the tubular snout member 62 to a ram position, as illustrated in FIG. 6. More specifically, the lower discharge end 58 of the tubular snout member 62 complements the spherical shape of the plug and, as the snout member 62 is moved downwardly, the discharge end engages the spherical plug and thereafter the snout member 62 is moved further to the ram position forcing the plug into sealing engagement with the container-receiving passage 14. It will be appreciated that the spherical plug is slightly larger in diameter than the container-receiving passage 14 to thereby effect the proper seal.

Once the container is sealed, the snout means 54 is retracted upwardly to its initial position shown in FIG. 3 and the filled container 12 is removed but not until the valve 36 shuts off access to the vacuum source because when the container 12 is removed, the vacuum would be broken in the fill passageway 30. After the container is removed and the vacuum is broken, the plug valve member 48 is retracted to the position shown in FIG. 6 to place a new plug against the plunger 44 for the next operation.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

The embodiments of the invention in which an exclusive property or privilege is claimed are defined as follows:

1. A filling assembly (10) for filling a container (12) through a receiving passage (14) of a predetermined length therein with particulate material, said assembly (10) including a housing (26) having a fill passage (30) for communicating with the receiving passage (14) of a container (12), by snout means (54) movably supported by said housing (26) and having a material delivery passage (56) for receiving material and having a discharge end (58) opening into the container-receiving passage (14) which is communicating with said fill passage (30), said snout means (54) being movable in said fill passage (30) between an initial position in said fill passage (30) and a fill position extending through said fill passage (30) and, to a predetermined extent, into the receiving passage (14) of the container (12) for delivering material through said delivery passage (56) until the container (12) is full of the material to said discharge end (58) whereupon particulate material flow through said delivery passage (56) automatically ceases, and material delivery valve means (68) movably mounted within said snout means (54) and having a downstream end (70) controlling the flow of material into said delivery passage (56), valve actuation means (74) for moving said valve means within said snout means to terminate the flow of material into said delivery passage (56) after the container (12) is full to said discharge end (58) and snout actuation means (72) for retracting said snout means (54) from the receiving passage (14) of said container (12) to empty the material in said snout means (54) downstream of said downstream end (70) of said material delivery valve means (68) into the receiving passage (14) of the container without overflow of said receiving passage (14), the volume of said delivery passage (56) below said delivery valve means (68) being less than the volume of said predetermined extend of extension of said snout means (54) into the receiving passage (14) of the container (12).

2. An assembly as set forth in claim 1 including sealing plug means (38) for delivering a sealing plug larger than the container-receiving passage (14) to said fill passage (30) and further characterized by said snout means (54) being movable to a ram position extending through said fill passage (30) and into the receiving passage (14) of the container (12) for forcing the sealing plug into the receiving passage (14) to seal the container (12).

3. An assembly as set forth in claim 2 further characterized by said snout means (54) including a material delivery chamber (63) above said delivery passage (56) thereof, said material delivery valve means (68) controlling the flow of material from said delivery chamber (63) to said delivery passage (56) of said snout means (54), and a material delivery tube (64) communicating with said delivery chamber (63) and adapted for connection to a source of material.

4. An assembly as set forth in claim 3 further characterized by including snout actuation means (72) for moving said snout means (54) and said delivery valve means (68) between said initial, fill and ram positions while maintaining said delivery valve means (68) closed to prevent material flow from said delivery chamber (63) into said delivery passage (56).

5. An assembly as set forth in claim 4 further characterized by including valve actuation means (74) for opening said delivery valve means (68) to allow material flow from said delivery chamber (63) into said delivery passage (56) to fill the container (12) when said snout means (54) is in said fill position.

6. An assembly as set forth in claim 5 further characterized by including vacuum means (32) for withdrawing gas from the container (12) and fill passage (30) and delivery passage (56) while said snout means (54) is in said initial position.

7. An assembly as set forth in claim 6 further characterized by said sealing plug means (38) including a plug passage (40) for delivering a sealing plug to said fill passage (30), plug stop means (42, 44) for retaining a sealing plug in said plug passage (40) and allowing the sealing plug to pass into said fill passage (30), and plug magazine means (46, 48) movable between a sealing position for sealing off said plug passage to maintain a vacuum therein and an open position for delivering one plug to said plug passage (40) upon each opening thereof.

8. An assembly as set forth in claim 7 further characterized by including support structure (20, 22, 24) supporting said housing (26) and said snout actuator means (72), said valve actuation means (74) being supported by said snout means (54).

9. An assembly as set forth in claim 8 further characterized by including an annular valve seat (66) between said delivery chamber (63) and said delivery passage (56) of said snout means (54), said delivery valve means (68) comprising a tubular valve member (68) having an annular sharp end (70) for engaging said valve seat (66).

10. An assembly as set forth in claim 9 further characterized by including a cylindrical sealing mandrel (78) supported in a stationary fashion by said support structure (20, 80) and extending through said tubular valve member (68) to a pointed lower end (82) so that the pointed lower end (82) engages the inner periphery of said annular valve seat (66) inside of said tubular valve member (68) when said snout means (54) is in said initial position to maintain the vacuum.

11. An assembly as set forth in claim 10 further characterized by said housing having a cylindrical guideway (28), said snout means (54) including a circular piston-like portion (59) in sliding engagement with said guideway (28) and a tubular snout member (62) of smaller diameter than said piston-like portion (59) and extending downwardly therefrom and into said full passage (30).

12. An assembly as set forth in claim 11 further characterized by said plug being a sphere and said discharge end (58) of said tubular snout member (62) being shaped for complementary engagement with the sphere.

* * * * *